US009235161B2

(12) United States Patent
Kawasumi

(10) Patent No.: US 9,235,161 B2
(45) Date of Patent: Jan. 12, 2016

(54) IMAGE FORMING APPARATUS

(71) Applicant: CANON KABUSHIKI KAISHA, Tokyo (JP)

(72) Inventor: Ryoichi Kawasumi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/080,873

(22) Filed: Nov. 15, 2013

(65) Prior Publication Data

US 2014/0140725 A1 May 22, 2014

(30) Foreign Application Priority Data

Nov. 21, 2012 (JP) ..... 2012-255256

(51) Int. Cl.
*G03G 15/04* (2006.01)
*G03G 15/08* (2006.01)

(52) U.S. Cl.
CPC ..... *G03G 15/0879* (2013.01)

(58) Field of Classification Search
CPC ..... G03G 15/04
USPC ..... 399/119
See application file for complete search history.

(56) References Cited

U.S. PATENT DOCUMENTS

| | | | | |
|---|---|---|---|---|
| 6,795,660 | B2 * | 9/2004 | Yugeta et al. | 399/27 |
| 7,269,376 | B2 * | 9/2007 | Shoji | 399/111 |
| 8,428,496 | B2 * | 4/2013 | Izawa et al. | 399/239 |
| 2005/0185983 | A1 * | 8/2005 | Ahn | 399/111 |
| 2006/0083544 | A1 * | 4/2006 | Okabe | 399/111 |
| 2007/0116495 | A1 * | 5/2007 | Kimura et al. | 399/258 |
| 2008/0159775 | A1 * | 7/2008 | Koishi et al. | 399/90 |
| 2008/0187366 | A1 * | 8/2008 | Moon et al. | 399/258 |
| 2008/0304868 | A1 * | 12/2008 | Woo | 399/258 |
| 2009/0103951 | A1 * | 4/2009 | Tsuda | 399/254 |
| 2010/0135693 | A1 * | 6/2010 | Okabe et al. | 399/111 |
| 2011/0293325 | A1 * | 12/2011 | Okabe | 399/113 |
| 2013/0287452 | A1 * | 10/2013 | Yoshida et al. | 399/281 |

FOREIGN PATENT DOCUMENTS

| | | | |
|---|---|---|---|
| JP | 04-318875 | A | 11/1992 |
| JP | 2865893 | B2 | 3/1999 |
| JP | 2003-015420 | A | 1/2003 |
| JP | 2011-017778 | A | 1/2011 |
| JP | 5163603 | B2 | 3/2013 |

* cited by examiner

*Primary Examiner* — Rodney Fuller
(74) *Attorney, Agent, or Firm* — Fitzpatrick, Cella, Harper & Scinto

(57) ABSTRACT

An image forming apparatus includes an apparatus body, an image bearing member, and a development cartridge which has a developer bearing member that is detachable and attachable against the apparatus body. In addition, a supply portion supplies a developer to the development cartridge and is configured to connect and separate from the development cartridge in the apparatus body in the vertical direction, and a movement mechanism moves the development cartridge away from a surface of the image bearing member by supporting the development cartridge and moving it from an attached position in a substantially vertical direction. A seal portion is configured around a connecting portion between the supply portion and the development cartridge and can seal the connecting portion by compressing with movement of the development cartridge by the movement mechanism.

9 Claims, 12 Drawing Sheets

IMAGE FORMING APPARATUS

BACKGROUND OF THE INVENTION

1. Field of the Invention

The present invention relates to an image forming apparatus including a drum unit and a development unit.

2. Description of the Related Art

Conventionally, there has been disclosed an image forming apparatus in which a plurality of image process units each having a drum unit and a development unit is detachably attachable and are aligned horizontally along an intermediate transfer belt (e.g., Japanese Patent Laid-Open No. 2003-15420).

However, in the configuration described in the Japanese Patent Laid-Open No. 2003-15420, a configuration of supplying toner from a supply unit to a development unit and a configuration of discharging the toner from the development unit to a disposal unit cannot be compatible with an exchanging performance of the development unit without difficulty. For attaining the compatibility between them, problems of complicating the toner conveying path and increasing sizes of an apparatus body arise.

In many cases, the toner conveying path extends in a vertical direction, and the supply and discharge of the toner with respect to a development unit are performed in the vertical direction. In a configuration having image process units aligned horizontally, however, the development unit and the drum unit are separated horizontally from each other when the development unit and the drum unit are exchanged.

Therefore, when the development unit is to be separated, for example, horizontally, a whole or a part of the toner conveying path must be configured to move in the horizontal direction together with the development unit. Alternatively, toner dispersion must be prevented at the time of the separation or contact by fixing the toner conveying path and arranging a shutter in a sealed fashion in a separation/contact portion separating or contacting the development unit from or with the drum unit.

SUMMARY OF THE INVENTION

In view of the above, it is desirable to provide an image forming apparatus that can simplify paths for supplying and discharging toner, and can suppress dispersion of the toner during exchanging of a development unit.

An image forming apparatus comprising: an image bearing member; a development cartridge which has a developer bearing member that bears a developer and develops an electrostatic image on the image bearing member with the developer, and is detachable and attachable against an apparatus body, wherein the developer bearing member is located at the position where a line linked between a center of the image bearing member and a center of the developer bearing member slants against horizontal direction and vertical direction on a section at right angles to the axis direction of the image bearing member; a supply portion connected with a supply port arranged in an upper aspect of the development cartridge and supplying the developer; a movement mechanism which retreats the development cartridge from a surface of the image bearing member by supporting movable the development cartridge from attached position to substantially vertical direction.

Further features of the present invention will become apparent from the following description of exemplary embodiments with reference to the attached drawings.

DESCRIPTION OF THE EMBODIMENTS

Figure 1:
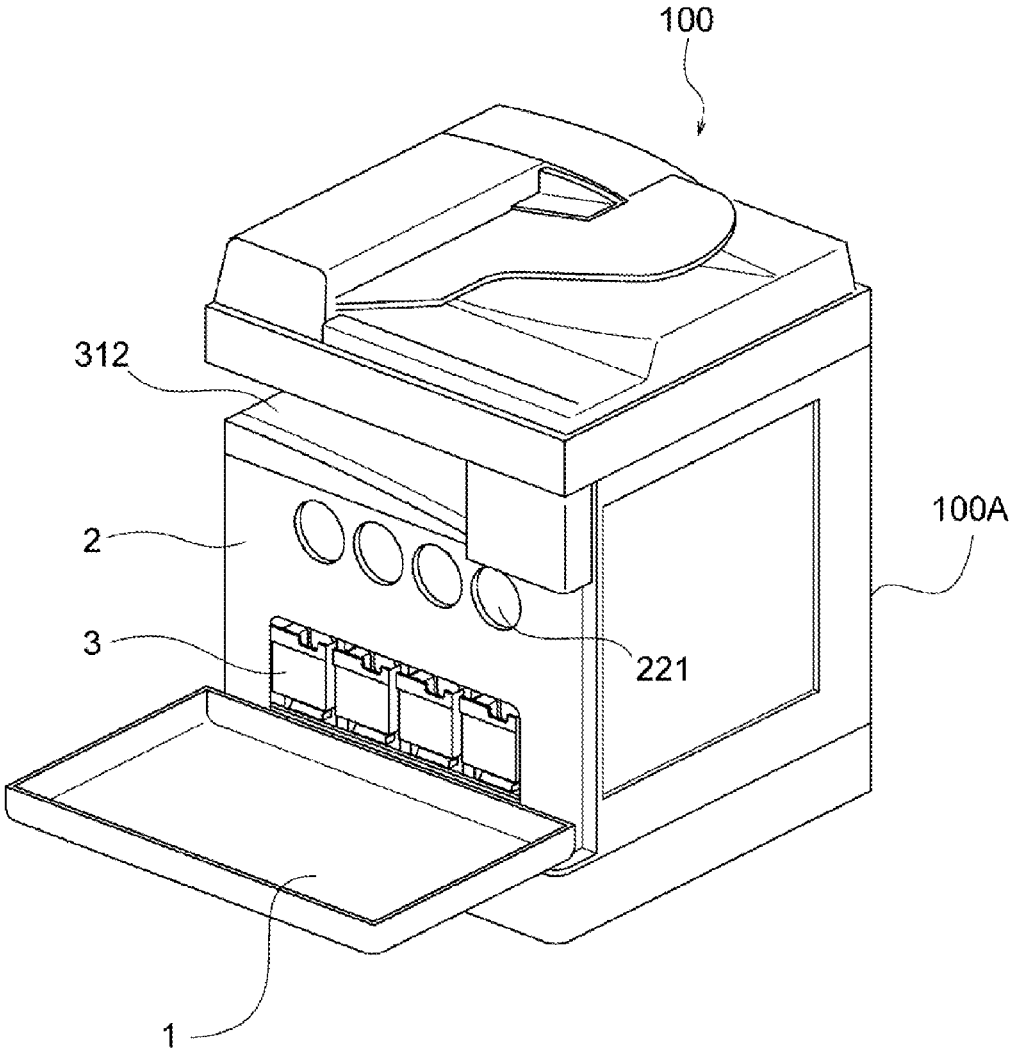
FIG. 1 is a perspective view illustrating a configuration of an image forming apparatus with its front cover open.
Figure 2:
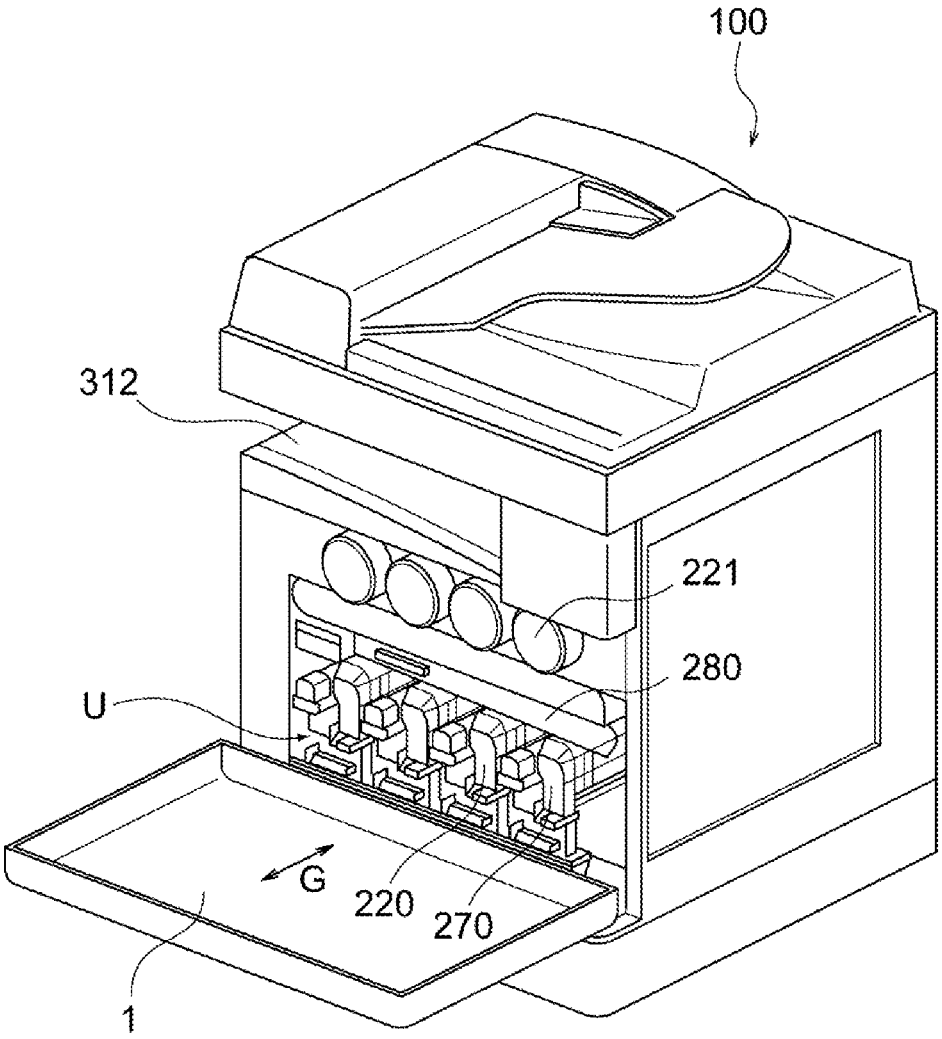
FIG. 2 is a perspective view of the image forming apparatus illustrating an arrangement of units inside an apparatus body, assuming that an inner cover, a part of a frame and horizontally aligned small covers are all transparent.

FIG. 1 is a perspective view illustrating a configuration of an image forming apparatus 100 with its front cover 1 opened. FIG. 2 is a perspective view of the image forming apparatus 100A illustrating an arrangement of units inside an apparatus body 100A, assuming that an inner cover 2, a part of a frame and a plurality of horizontally aligned small covers 3 are all transparent. As illustrated in FIG. 2, four process units U (see FIG. 2) that are "image formation process units" are horizontally aligned in a center of the apparatus body 100, and form images in different colors, respectively. The process unit U includes a drum unit 270 (a drum cartridge) and a development unit 220 (a development cartridge). The unit configuration of each color is the same as the others, and therefore numbers are assigned only to the unit in the right end, and are not assigned to the others. Each of the drum unit 270 and the development unit 220 is a cartridge that is independently detachable and attachable from or to the apparatus body, and this improves exchangeability.

An intermediate transfer belt 280 is arranged above the process units U in an opposed fashion. Consequently, the intermediate transfer belt 280 that is a "transfer portion" (transfer apparatus) is arranged above the drum unit 270 and the development unit 220. In this arrangement, an exposure unit (not illustrated) (exposure apparatus) is arranged under the drum unit 270.

The intermediate transfer belt 280 passes around various rollers such as a secondary transfer roller, idler roller, and tension roller, although not illustrated. The secondary transfer roller is arranged along a conveying path of a transfer member of an image, and cooperates with an opposed roller to form a nip. Further, four toner cartridges 221 that are supply devices supplying toners of different colors, respectively, are aligned and arranged immediately above the intermediate transfer belt 280. The toner cartridge 221 is independent of the drum unit, is arranged in the apparatus body in a detachably attachable fashion, and will be exchanged with a new one when it becomes empty. Similarly to the development units and others, the toner cartridges 221 have the same configurations, and only the cartridge at the right end bears the number, and others do not bear it.

The apparatus body 100A is provided at its deep position with a toner supply unit (not illustrated) which receives the toner from the toner cartridge 221 and supplies the toner to the development unit 220. Further, the image forming apparatus 100 has a laser unit and a sheet cassette located under the process unit U, as well as a fixing device located along a sheet conveying path in a side portion inside the apparatus body 100A, and further has devices such as a sheet discharge tray 312 receiving the discharged sheets bearing the fixed toner images. For minimizing the sizes of the image forming apparatus 100 and minimizing the length of the sheet conveying path, the above unit arrangement or the substantially the same arrangement are employed.

The laser unit is arranged under the process unit, and this arrangement restricts a relative position relationship between the drum unit 270 and the development unit 220. Since the laser unit irradiates a lower surface of a photosensitive drum 210 with laser emitted upward, the development unit 220 must be shifted and arranged in a side position not intercepting the laser.

Although the development unit 220 includes a development roller 211 opposed to the photosensitive drum 210 (see FIG. 3), the arrangement angle of the opposed development roller 211 falls within a range of 60 degrees with respect to the horizontal direction.

The image forming apparatus 100 includes the front cover 1 as an access door to an inside of the apparatus. The development unit 220 and the drum unit 270 are attached, detached and exchanged by opening the front cover 1 from the front side of the apparatus, then opening the small cover 3 to expose the intended unit, and extracting or inserting the unit in a direction G illustrated in FIG. 2.

In general, the development unit 220 and the drum unit 270 have durable lives shorter than a guaranteed life of the image forming apparatus body, and require exchanging when predetermined lives expire. The life is often expressed by the number of transfer members subjected to the image formation. In many cases, when the life of the apparatus body is equivalent, for example, to 500 K sheets, the life of the drum unit 270 is equivalent to about 50 K sheets. In this case, the drum unit 270 must be exchanged about ten times within the life duration of the apparatus body.

Then, the operation of the image forming apparatus 100 will be described. The laser unit forms an electrostatic image on a surface of the photosensitive drum 210 (see FIG. 3). The development unit 220 develops this electrostatic image to form a toner image. The toner image is primarily transferred onto the intermediate transfer belt 280. Since the process unit U has the drum units 270 corresponding to the multiple colors, respectively, toner images of the respective colors are successively overlaid on the surface of the intermediate transfer belt 280 to form a color toner image.

Meanwhile, the transfer members are fed one by one from the cassette, and are conveyed to the secondary transfer roller through the conveying path (not illustrated). When the transfer member reaches the nip of the secondary transfer roller, the color toner image already described is secondarily transferred onto the surface of the transfer member. The fixing device (not illustrated) fixes the toner image onto the transfer member, which is discharged onto the sheet discharge tray 312.

Figure 3:
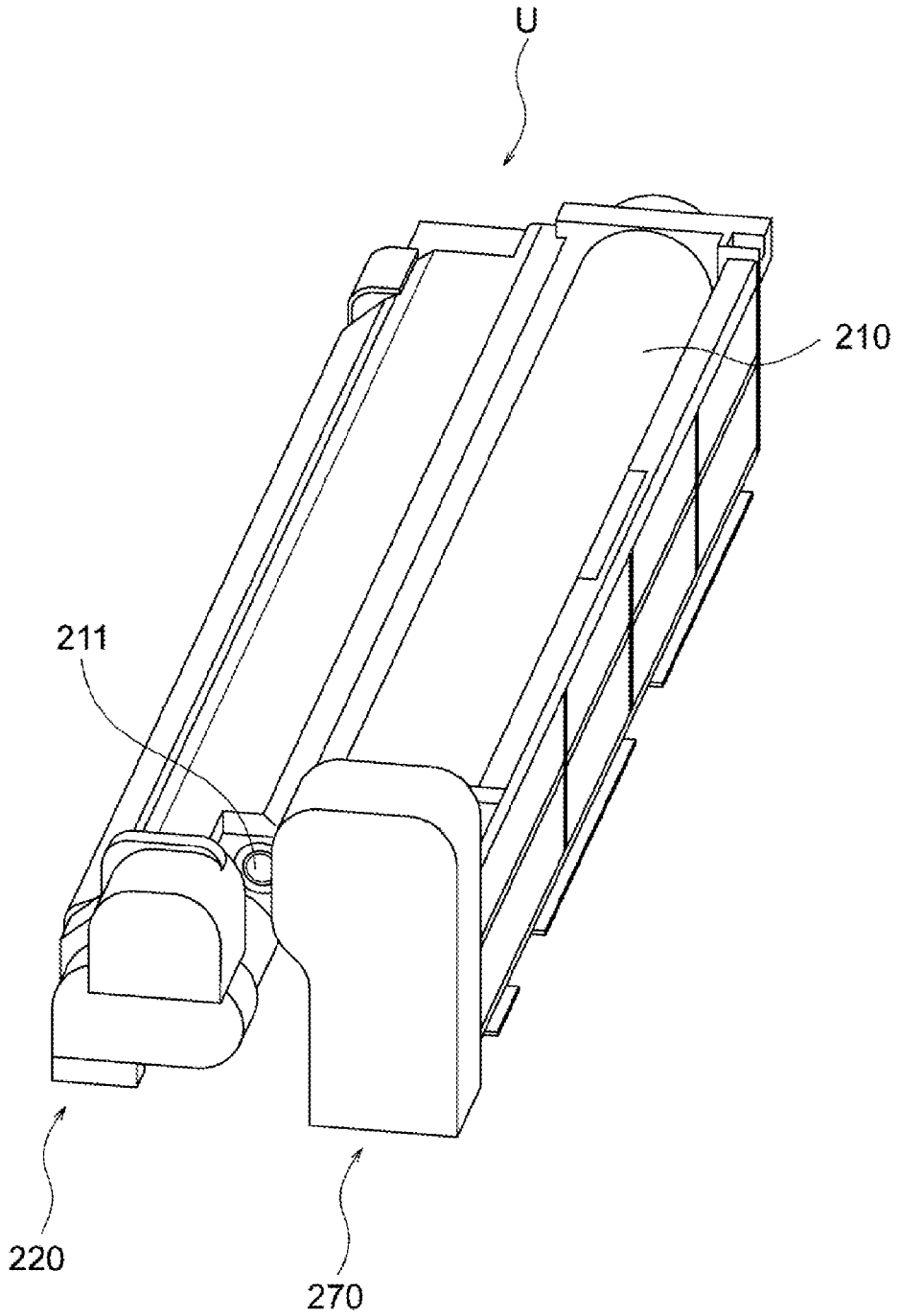
FIG. 3 is a perspective view of a process unit.
Figure 4:
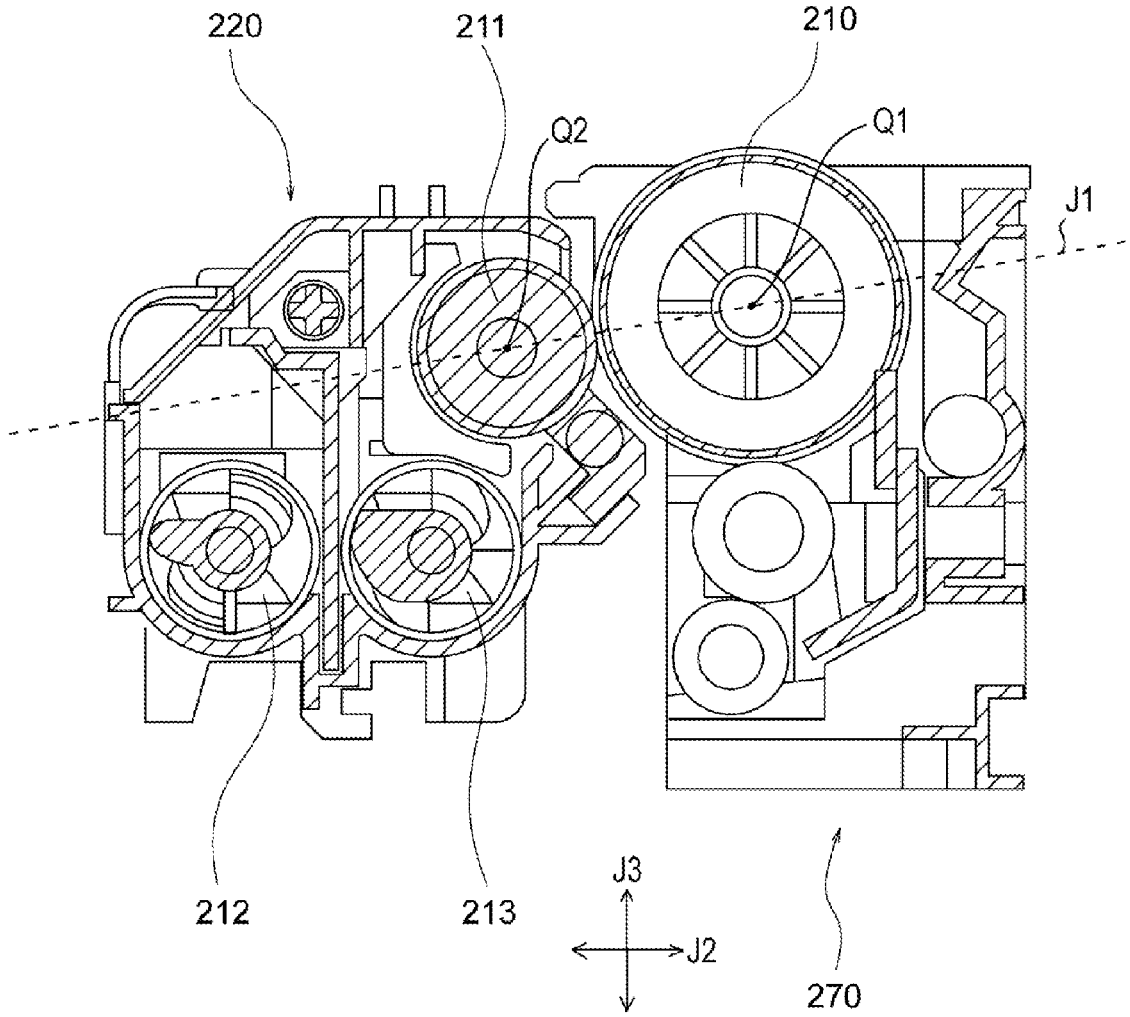
FIG. 4 is a cross section of the process unit.

FIG. 3 is a perspective view of the process unit U. FIG. 4 is a cross section of the process unit U. As illustrated in FIGS. 3 and 4, the process unit U includes the drum unit 270 having the photosensitive drum 210 that is the "image-bearing member", and the development unit 220 having the development roller 211 for developing the electrostatic image on the photosensitive drum 210 with the developer. Each of the drum unit 270 and the development unit 220 is a unit which takes a form of a cartridge and is detachably attachable with respect to the apparatus body 100A in an axial direction of the photosensitive drum 210.

The development unit 220 is a development device of a type using two-component toner developer. The development roller 211 and the photosensitive drum 210 are close to each other with a predetermined distance therebetween. The development roller 211 is preferably opposed to the photosensitive drum 210 within a range of 60 degrees in each of upper and lower sides with respect to a horizontal plane extending through a center axis of the photosensitive drum 210. The development roller 211 is located at the position where a line J1 linked between a center Q1 of the photosensitive drum 210 and a center Q2 of the development roller 211 slants against horizontal direction J2 (horizontal line) and vertical direction J3 on a section at right angles to the axis direction of the photosensitive drum 210. As illustrated in FIG. 4, the development unit 220 includes conveying screws 212 and 213 for conveying the supplied toner to the development roller 211.

Figure 5:
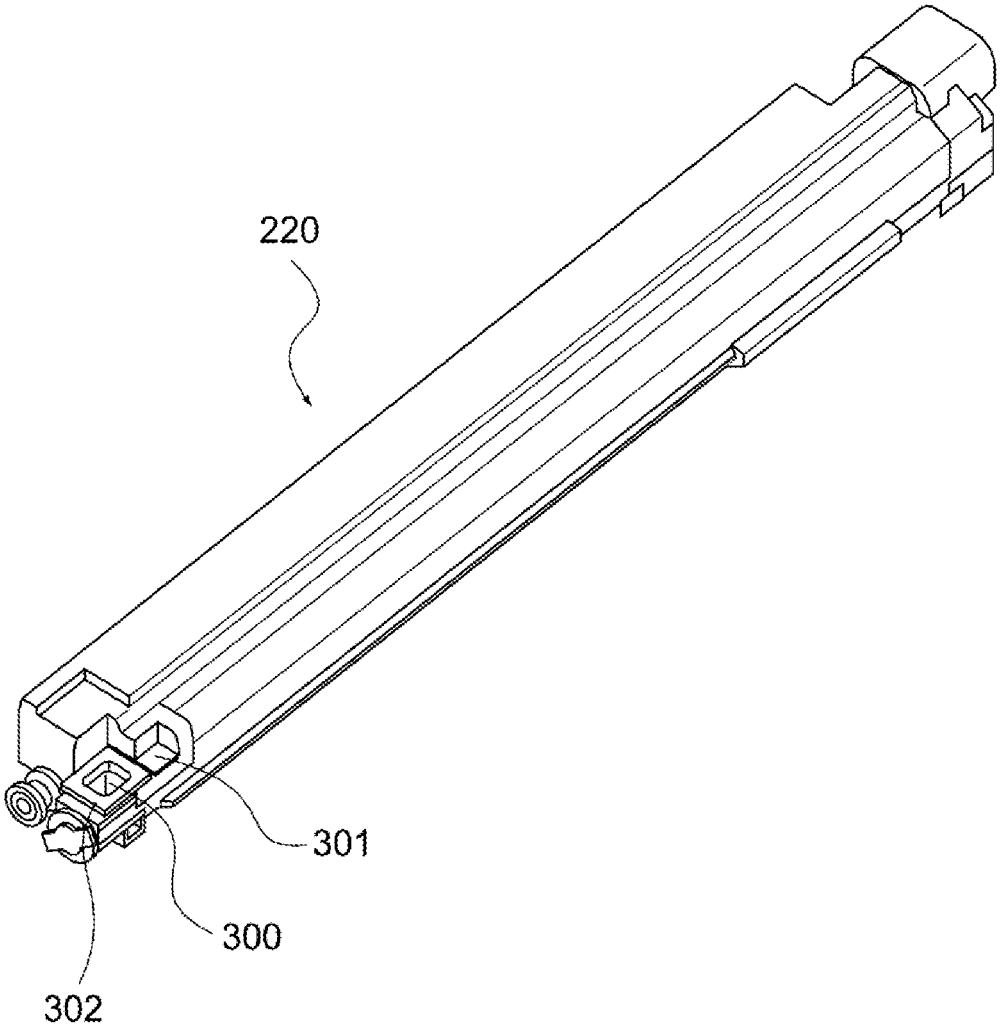
FIG. 5 is a perspective view of a development unit.
Figure 6:
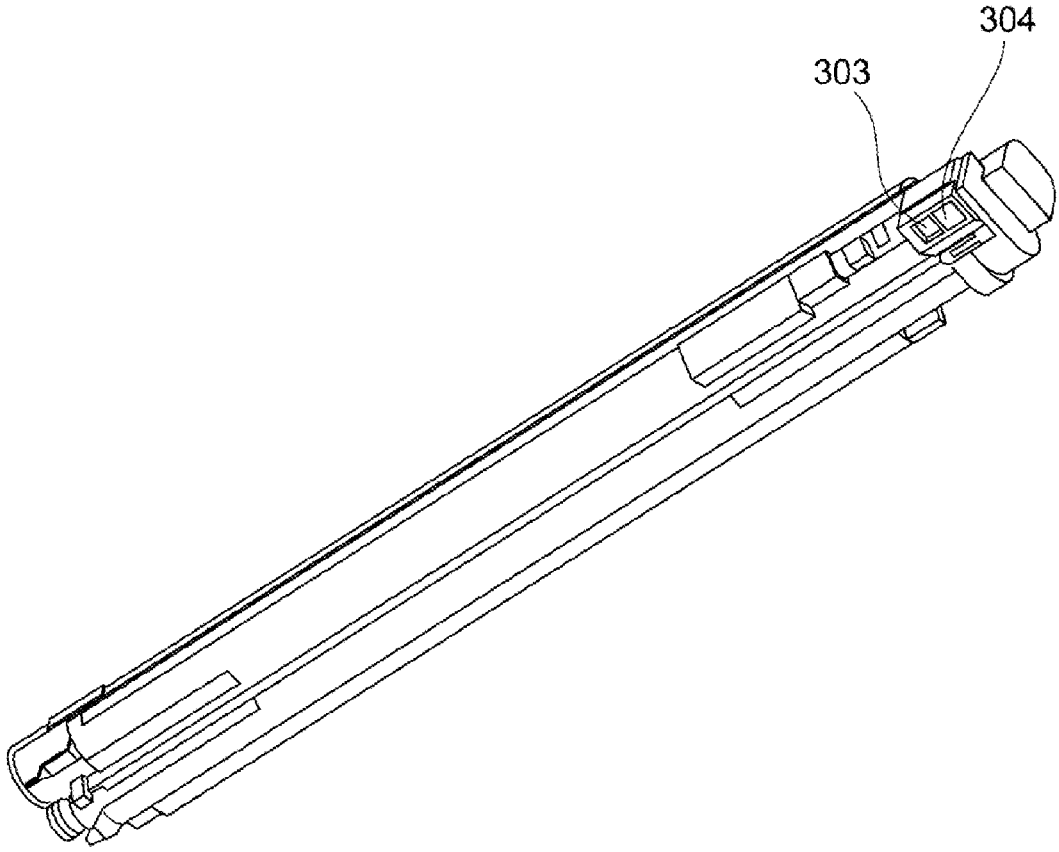
FIG. 6 is a perspective view of the development unit.

FIGS. 5 and 6 are perspective views of the development unit 220. FIG. 5 is a perspective view of a supply port 300 viewed from an upper side, and FIG. 6 is a perspective view of a discharge port 303 viewed from a lower side. As illustrated in FIG. 5, the supply port 300 receiving the supplied toner as well as a supply shutter 301 and a seal 302 are arranged immediately above the conveying screw 212 behind the development unit 220. As illustrated in FIG. 6, the discharge port 303 for discharging the toner which is deteriorated due to use in image formation as well as a discharge shutter 304 are arranged in or on the lower surface of the development unit 220. The discharge port 303 that is "a discharge portion" is a port for discharging the developer in the development unit 220. The discharge port 303 discharges the developer substantially vertically downward.

When the development unit 220 is to be detached from or attached to the apparatus body 100A, the supply shutter 301 covers the supply port 300, and the discharge shutter 304 covers the discharge port 303 to keep sealing the developer therein.

Figure 7:
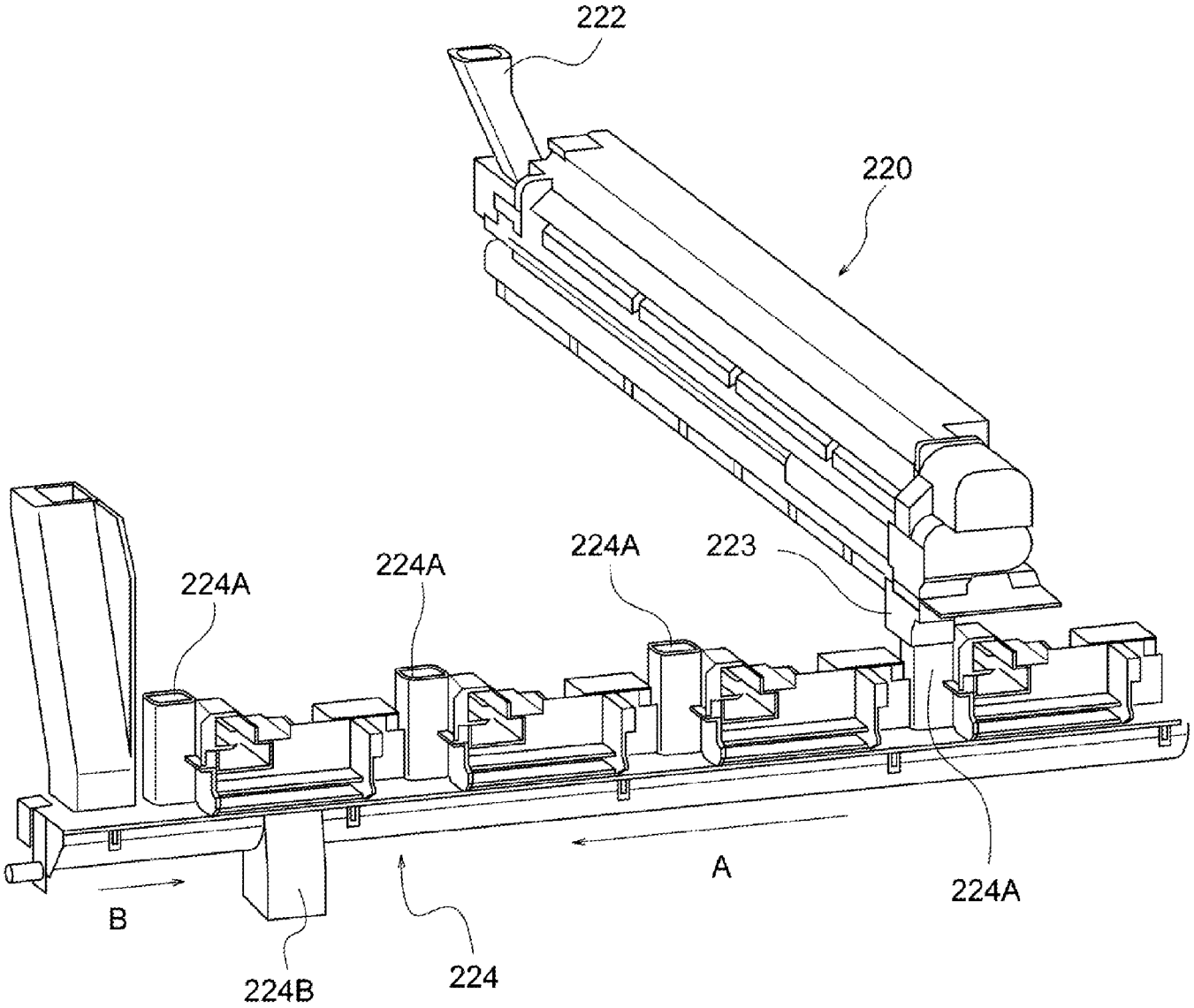
FIG. 7 is a perspective view illustrating configurations of the development unit and a collecting and conveying unit.

FIG. 7 is a perspective view illustrating configurations of the development unit 220 and a collecting and conveying unit 224. Referring to FIG. 7, a developer conveying path from the supply of the toner to the discharge will be described below. FIG. 7 illustrates a supply pipe 222 configured in a downstream end of the toner supply unit. This supply pipe 222 is connected to the supply port 300 (see FIG. 5) formed behind the development unit 220 (i.e., on the back side of the sheet of FIG. 7). FIG. 7 also illustrates a relay unit 223 serving as a relay member which discharges the developer from the development unit 220 to the collecting and conveying unit 224. The relay unit 223 is connected to the discharge port 303 (see FIG. 6) formed in front of the development unit 220 (i.e., on the forward side of the sheet of FIG. 7).

The collecting and conveying unit 224 has four openings 224A in positions corresponding to the respective development units 220 for receiving the discharged developers of the respective colors. A discharge port 224B is also arranged for passing the developer to a developer collection box (not illustrated) arranged in a lower portion of the apparatus.

Accordingly, the conveying pass of the developer is as follows. First, the toner moves vertically downward from the toner cartridge 221 through the supply pipe 222, and is supplied to the development unit 220. Then, the developer of each color which is deteriorated due to use in the image formation inside the development unit 220 moves vertically downward through the relay unit 223 and the opening 224A, and is discharged into the collecting and conveying unit 224.

Finally, the deteriorated developer collected in the collecting and conveying unit 224 is conveyed in the directions of arrows A and B, is discharged vertically downward through the discharge port 224B, and is collected in the developer collection box (not illustrated).

Figure 8:
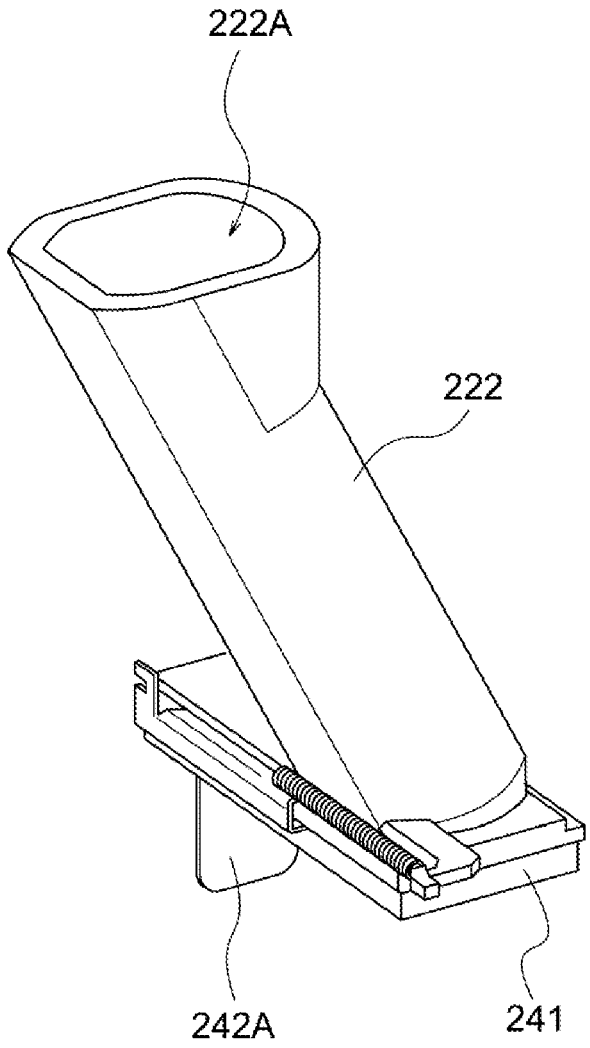
FIG. 8 is a perspective view of a supply pipe.
Figure 9:
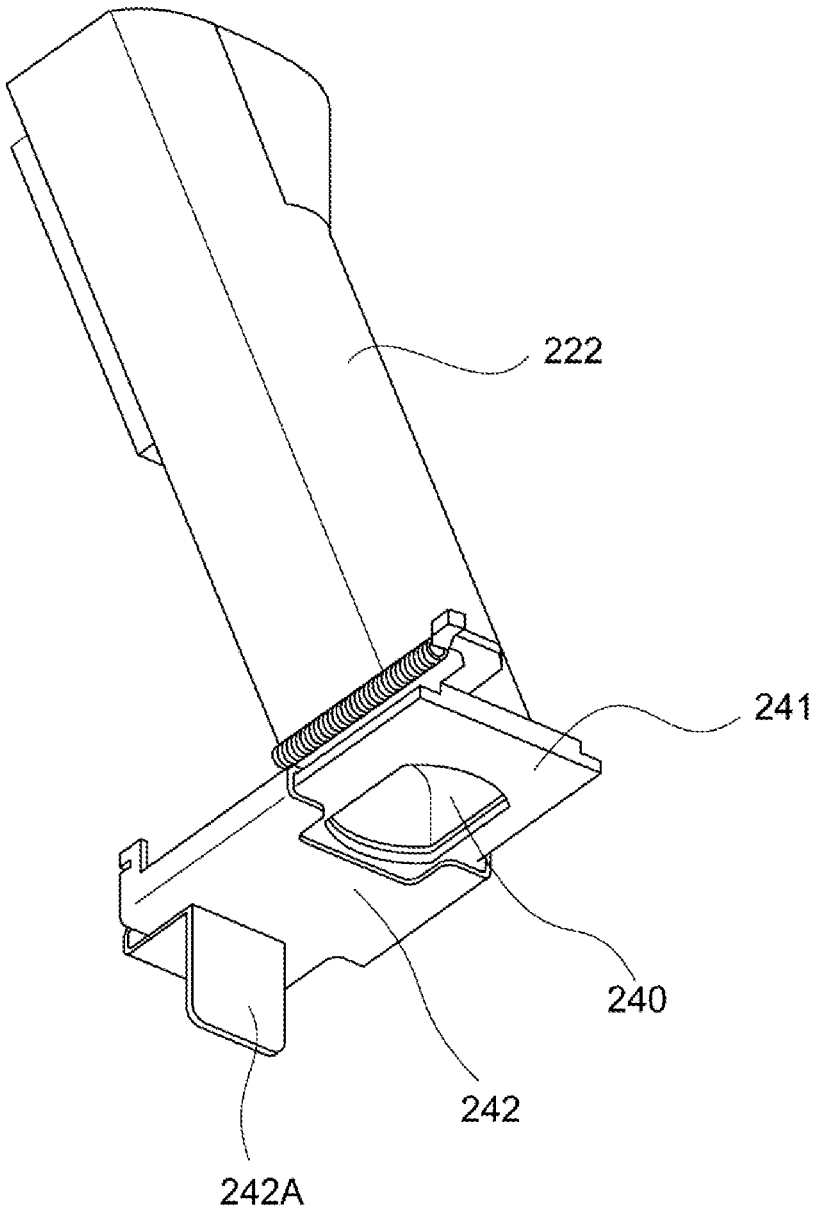
FIG. 9 is a perspective view of the supply pipe.

FIGS. 8 and 9 are perspective views of the supply pipe 222. FIG. 8 is equivalent to a perspective view in which an opening 222A of the supply pipe 222 can be seen from an upper side. FIG. 9 is equivalent to a perspective view in which a supply port 240 of the supply pipe 222 can be seen from a lower side. The supply pipe 222 that is "a supply portion" supplies the developer to the development unit 220. The supply pipe 222 performs the supply in the substantially vertically downward direction. In this embodiment, the toner cartridge 221 and the supply pipe 222 form a supply portion supplying the toner to the development cartridge.

When the development unit 220 is attached to the inside of the apparatus body 100A, the development unit 220 is connected to the supply pipe 222 owing to opening of the supply shutter 301, and is connected to the relay unit 223 owning to the opening of the discharge shutter 304. As illustrated in FIGS. 8 and 9, the supply pipe 222 is provided at its upper portion with the opening 222A receiving the supply of the toner, and is provided at its lower portion with the supply port 240 for supplying the toner to the development unit 220 as well as a supply seal 241, and a supply shutter 242.

When the development unit 220 is removed from the apparatus body 100A, the supply shutter 301 is closed so that the supply port 240 of the development unit 220 is closed. Also, the discharge shutter 304 is closed so that the discharge port 303 is closed. The supply shutter 242 is biased by a spring to close the supply port 240.

In the state where the supply shutter 242 closes the supply port 240, the supply seal 241 adhered between the supply port 240 and the supply shutter 242 ensures the sealing of the supply pipe 222 for the toner. The supply seal 241 has a predetermined collapse amount M which is set with respect to the surface of the supply shutter 242, and this collapse amount eliminates a gap and ensures the sealing for the toner. Therefore, when the supply shutter 242 opens while the development unit 220 is not present, the supply seal 241 rises by M from the shutter plane. The supply shutter 242 opens when the development unit 220 pushes and slides a shutter arm 242A.

In the state where the development unit 220 is attached to the apparatus body 100A, both the supply seal 241 of the supply pipe 222 and the seal 302 adhered to the development unit 220 perform the sealing around the supply port 240 for the toner. A predetermined collapse amount N is likewise set for the seal 302, and both the collapse amounts M and N ensure the sealing for the toner.

As illustrated in FIG. 4, the development unit 220 is arranged close to the photosensitive drum 210. When the unit is removed forward with respect to the apparatus, scratches may be formed on the photosensitive drum 210 or the development roller 211. Accordingly, the attaching and detaching of the development unit 220 or the drum unit 270 must be performed after separating them by a distance enough to prevent sliding contact. (In another manner, the development unit and the drum unit fixed together may be removed, and may be released from each other after the removal. However, this manner causes a significant disadvantage of lowering the exchange property of the units, and therefore this manner cannot be employed in this description.)

As can be intuitively understood from FIG. 4, the development unit 220 can be separated most reliably when it is separated in the direction of a straight line extending through axial centers of the development roller 211 and the photosensitive drum 210, that is, in a substantially horizontal direction.

However, the development unit 220 is connected to the supply pipe 222 and the relay unit 223 as described before, and the following manner may be employed for retracting the development unit 220 without dispersing the toner. For example, a bellows of rubber may be formed in a central portion of the supply pipe 222 for freely allowing L-shaped bending so that it can follow the movement of the development unit 220. However, this manner may cause, for example, such disadvantages that the toner accumulated in the bellows blocks the pipe, or the toner supply path to be simple is complicated. Accordingly, the invention retracts the development unit 220 in a direction of the toner conveying path, that is, a substantially vertical direction.

Figure 10A:
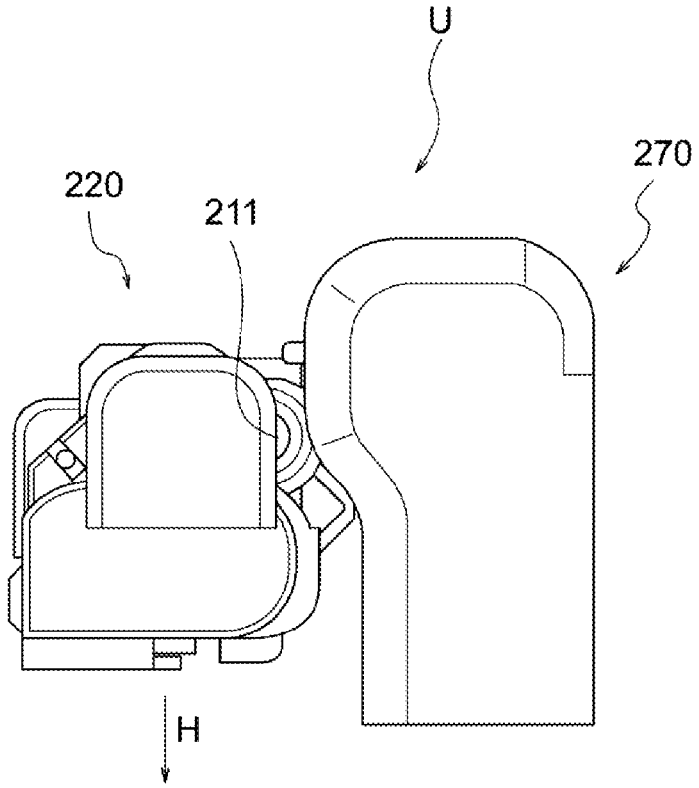
FIGS. 10A and 10B are elevations of a process unit.
Figure 10B:
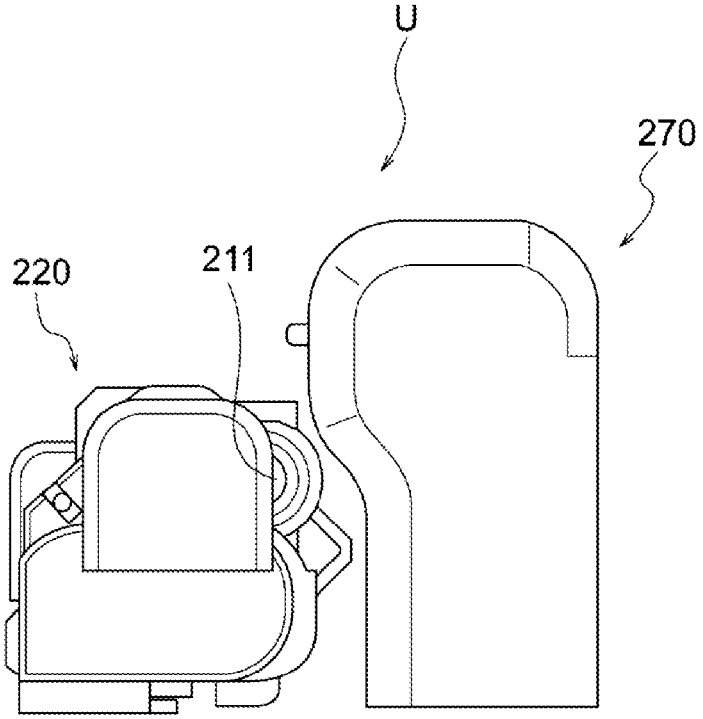

FIGS. 10A and 10B are elevations of the process unit U. In FIG. 10A, the development roller 211 is in contact with the photosensitive drum 210. In FIG. 10B, the development roller 211 is separated from the photosensitive drum 210. As illustrated in FIG. 10A, when the development roller 211 enters into the drum unit 270, the development unit 220 may slide on the photosensitive drum 210, and this positional relationship does not allow the removal toward the front side.

A separation/contact mechanism K moves the development unit 220 in a separation/contact direction parallel to the toner supply direction of the supply pipe 222. The separation/contact mechanism K separates the development unit 220 in a downward direction. Therefore, when the development unit 220 retracts in a direction of an arrow H illustrated in FIG. 10A (i.e., vertically downward direction). Thereby, as illustrated in FIG. 10B, the development roller 211 and the drum unit 270 engaged together are released from each other, and a predetermined gap is ensured between the development unit 220 and the drum unit 270. In the state illustrated in FIG. 10B, therefore, both the development unit 220 and the drum unit 270 can be individually removed toward the front side without damaging principal parts such as the photosensitive drum 210. The configuration for retracting the development unit 220 in a direction along the toner conveying path will be described below with reference to FIGS. 11 and 12.

Figure 11:
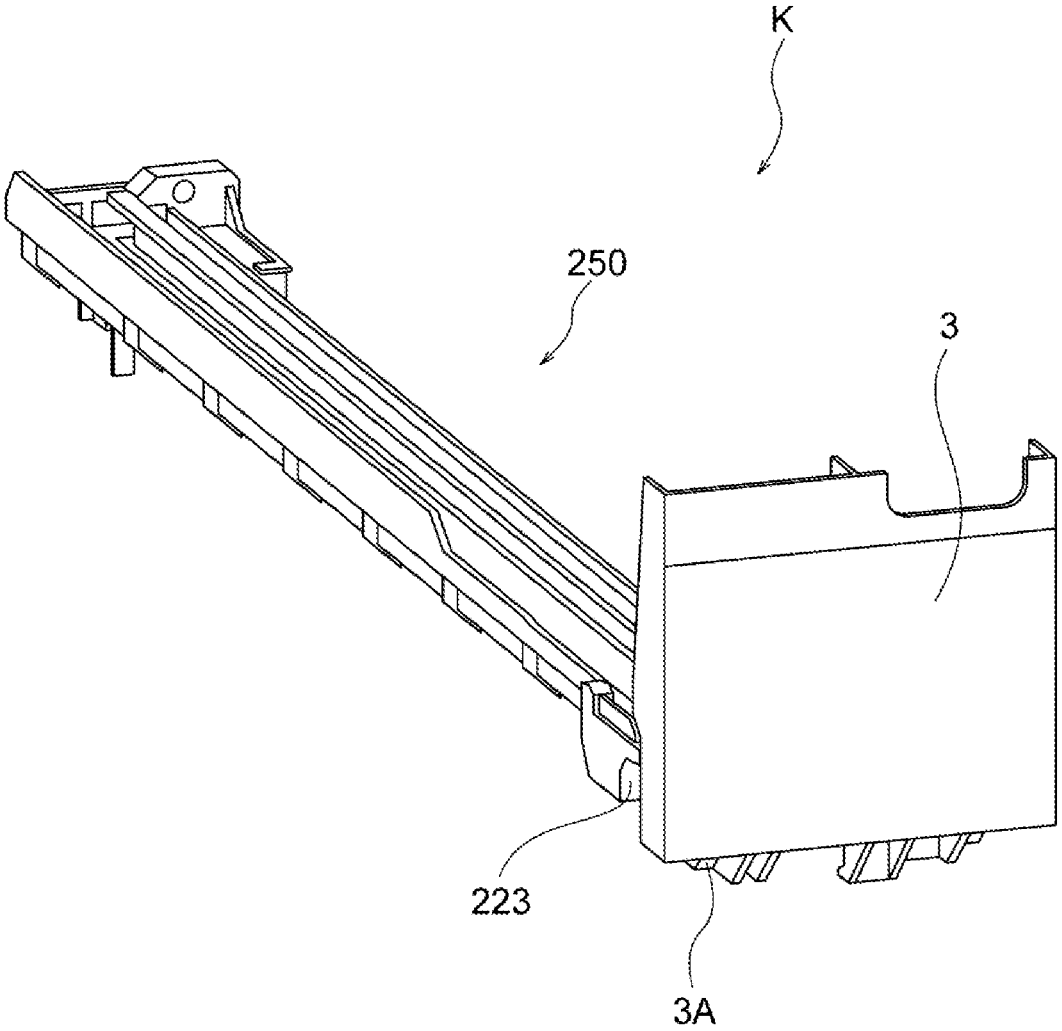
FIG. 11 is a perspective view of a separation/contact mechanism of the development unit.
Figure 12A:
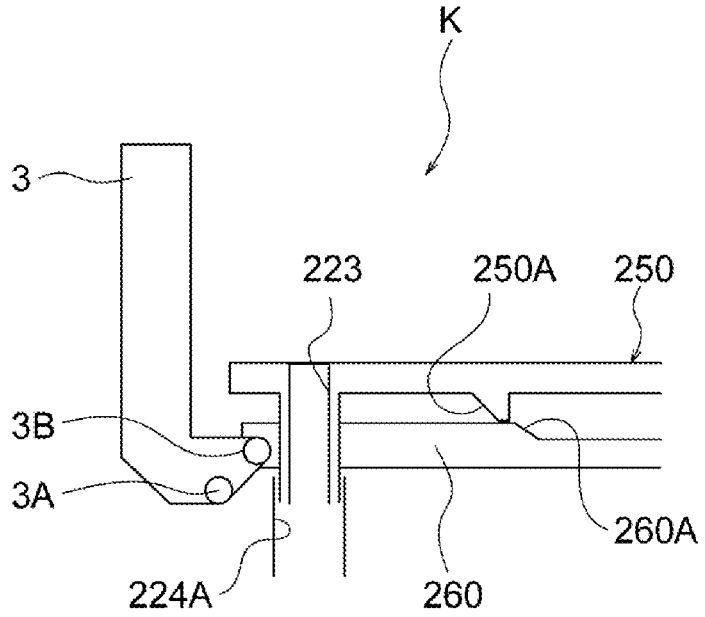
FIGS. 12A and 12B are cross sections of the separation/contact mechanism of the development unit.
Figure 12B:
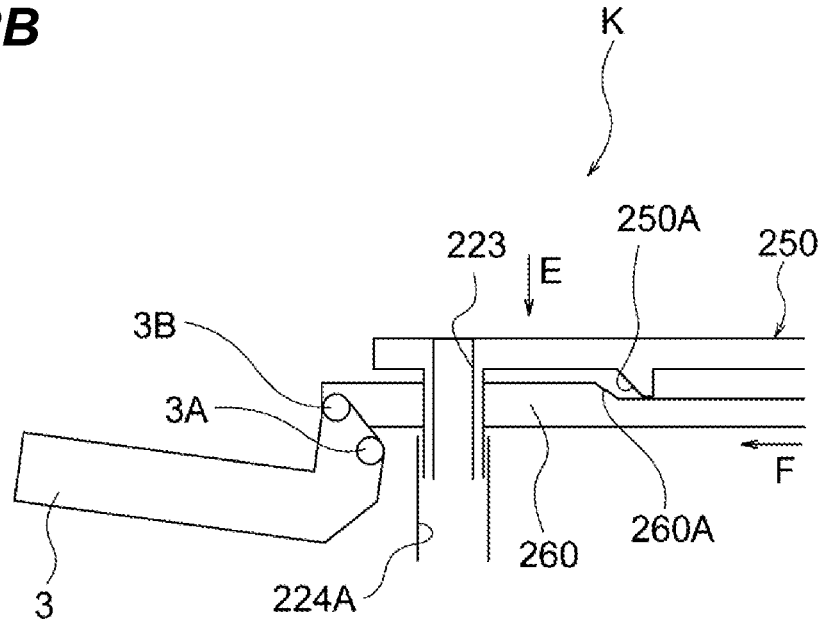

FIG. 11 is a perspective view of the separation/contact mechanism K of the development unit 220. FIGS. 12A and 12B are cross sections of the separation/contact mechanism K (separation/contact portion) of the development unit 220. The separation/contact mechanism K that is a "a movement mechanism" moves the development unit 220 for separation from or contact with the photosensitive drum 210. The separation/contact mechanism K has the small cover 3 that is a "cover member". The separation/contact operation caused by the separation/contact mechanism K is interlocked with the opening/closing operation of the small cover 3.

The separation/contact mechanism K has a development rail 250. The development rail 250 in FIG. 11 guides the development unit 220 when the development unit 220 is inserted into or removed from the apparatus body 100A, and also serves as a part of a developer supply path owing to formation of the relay unit 223 on a front side with respect to the sheet of FIG. 11. When the development unit 220 is attached to the inside of the apparatus body 100A, the separation/contact mechanism K also serves as a support of the development unit 220. As illustrated in FIGS. 12A and 12B, the relay unit 223 forms the conveying path of the developer with a predetermined amount of overlapping with respect to the upper opening 224A of the collecting and conveying unit 224. The amount of the overlapping is set enough to prevent dispersion of the developer.

Further, the development rail 250 is connected to the small cover 3 through a separation link 260. In a retracting procedure of the development unit 220, the small cover 3 is first opened, which serves as a trigger. The small cover 3 is rotatable around a rotation axis 3A, and is coupled to the separation link 260 via a link shaft 3B arranged at its end.

When the user rotates the small cover 3 counterclockwise from the state illustrated in FIG. 12A, the link shaft 3B moves in a direction of an arrow F as illustrated in FIG. 12B, and pulls out the separation link 260. The separation link 260 is provided at its upper surface with an inclined surface 260A. The inclined surface 260A is positioned to rise as the position moves toward the small cover 3, and to lower as the position moves away from it. Also, the development rail 250 is provided at its lower surface with an inclined surface 250A which has a convex form projecting vertically downward. The inclined surface 250A near the small cover 3 is set to rise as the position moves toward the small cover 3, and to lower as the position moves away from it.

When the small cover 3 is open, the inclined surfaces 260A and 250A are opposed to each other. According to the opening/closing of the small cover 3, the inclined surfaces 260A and 250A are engaged with each other. Therefore, when the small cover 3 is opened, it pulls the separation link 260 in the direction of the arrow F, the inclined surface 250A slides down on the inclined surface 260A, and the development rail 250 moves in a direction of an arrow E. The movement of the development rail 250 in the direction of the arrow E and an amount of such movement correspond to the retraction of the development unit 220 in the direction of the arrow E and the amount of such retraction.

The small cover 3 is in the closed position when the drum unit 270 and the development unit 220 are in contact with each other, and also serves as a prevention portion which prevents detaching and attaching of the drum unit 270 and the development unit 220 in the axial direction of the photosensitive drum 210. More specifically, when the small cover 3 is closed as illustrated in FIG. 12A, access to both the development unit 220 and the drum unit 270 cannot be performed as illustrated in FIG. 1. This serves to prevent a malfunction, for example, of inserting or pulling out the process unit U from or toward the front side in the state illustrated in FIG. 10A. Therefore, the development unit 220 can be easily attached and detached without complicating the configurations for supplying and discharging the developer, and can also prevent the malfunction.

Further, after the retracting of the development unit 220 (see FIG. 12B), only increase occurs in amount of overlapping of the relay unit 223 and the opening 224A in the vertical direction, and it can be understood that this increase is rather advantageous for the dispersion of the developer near the discharge port 303.

Near the supply port 300, the collapse amounts M and N of the seals can be set substantially equal to the movement amount of the development unit 220. This setting can minimize a space occurring between the supply paths, and can reduce the occurrence of the toner dispersion. For example, the retracting amount of the development unit 220 is set to 6 mm, and the seal collapse amounts M and N are set to 3 mm and 3 mm, respectively. In this case, the space between the seals near the supply port 300 becomes zero even in the state where the development unit 220 is merely inserted into the apparatus body 100A, that is, in the state where the development unit 220 has been retracted in the direction of the arrow E. By moving the development unit 220 upward from the above state, the seals collapse by the collapse amounts M and N equal to 6 mm, and the more reliable sealing is achieved for the tones.

The invention is not necessarily restricted to the foregoing configurations. For example, since the process unit U is arranged under the intermediate transfer belt 280, the retracting direction of the development unit 220 is vertically downward. However, the process unit U may be arranged above the intermediate transfer belt 280 (i.e., the intermediate transfer belt 280 may be arranged under the drum unit 270 and the development unit 220). In this case, the retracting direction of the development unit 220 is vertically upward (i.e., the separation/contact mechanism K separates the development unit 220 in the upward direction). In this case, the exposure portion may be arranged above the drum unit 270.

According to the configurations of the embodiment, the toner supply path and the toner discharge path with respect to the development unit 220 are connected together in the substantially vertical direction, and slide vertically for separation from the drum unit 270 of the development unit 220. These configurations can simplify the supply and discharge paths of the toner, and can suppress the dispersion and dropping of the toner during the exchanging operation of the development unit 220.

The invention can simplify the supply and discharge paths of the toner, and further can suppress the dispersion of the toner during the exchanging of the development unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-255256, filed Nov. 21, 2012, which is hereby incorporated by reference herein in its entirety.

What is claimed is:

1. An image forming apparatus comprising:

an apparatus body;

an image bearing member on which a latent image is formed;

a developing device provided detachably attachable to the apparatus body, configured to develop the latent image formed on the image bearing member, the developing device includes a developer bearing member bearing a developer and conveying the developer to a development position opposing the image bearing member and a receiving port for receiving the developer, wherein a line linked between a center of the developer bearing member and a center of the image bearing member slants against a horizontal plane in view from an axial direction of the image bearing member when the developing device is positioned at a set position where the developing device is to be set;

a supply device configured to supply the developer to the developing device positioned at the set position through a supply port provided in the supply device, wherein the receiving port is arranged under the supply port and capable of receiving the toner dropped from the supply port when the developing device is positioned at the set position; and a movement mechanism configured to move the developing device between the set position and a separate position where the developing device is away from the image bearing member, wherein the movement mechanism moves the developing device from the set position to the separate position vertically so as to separate the developing device from the supply device.

2. The image forming apparatus according to claim 1, further comprising:

a developing shutter which opens and closes the receiving port; and a developing seal member which is provided around the receiving port and seals around the receiving port when the developing device and the supply device are connected together, and which is compressed upon the movement of the developing device from the separate position to the set position by the movement mechanism.

3. The image forming apparatus according to claim 1, further comprising:

a supply shutter which opens and closes the supply port; and a supply sealing member which is provided around the supply port and seals around the supply port when the supply shutter is at a closed position, and which is compressed upon the movement of the developing device from the separate position to the set position by the movement mechanism.

4. The image forming apparatus according to claim 1, further comprising a cover member configured to open and close an insertion port through which the developing device is inserted, wherein in synchronization with the cover member, the movement mechanism is moved, and in connection with a closing operation of the cover member, the developing device is moved from the separate position to the set position.

5. The image forming apparatus according to claim 4, wherein an attachment and detachment operation of the developing device is regulated when the cover member is at a closed position.

6. The image forming apparatus according to claim 1, wherein the developing device is provided in a manner such as to be capable of being extracted from or inserted in the apparatus body along the axial direction of the image bearing member at the separate position.

7. The image forming apparatus according to claim 1, further comprising:

an intermediate transfer member which is arranged above the image bearing member and on which a toner image formed on the image bearing member is transferred; and an exposure device which is arranged under the image bearing member and forms the latent image on the image bearing member, wherein the separate position is provided under the set position.

8. The image forming apparatus according to claim 1, further comprising:

a discharge port which is provided under the developing device and discharges the developer from the developing device;

a conveying pipe which is fixed in the apparatus body and forms a conveying path conveying the developer discharged from the discharge port; and a relay member which forms a conveying passage therein conveying the developer discharged from the discharge port between the conveying pipe and the discharge port, which is provided in a manner such as to be movable together with the movement mechanism, which is provided in a manner such as to be vertically movable together with the developing device in connection with the movement of the movement mechanism, and which vertically overlaps with the conveying pipe when the developing device is at the set position and the separate position.

9. The image forming apparatus according to claim 1, wherein a position at which the developer bearing member and the image bearing member are closest to each other when the developing device is set at the set position is located in a region within 60 degrees in a circumferential direction of the image bearing member from a position at which the horizontal plane passing through the center of the image bearing member intersects with a surface of the image bearing member.

* * * * *